US009717316B2

(12) United States Patent
Attard-Kingswell et al.

(10) Patent No.: US 9,717,316 B2
(45) Date of Patent: Aug. 1, 2017

(54) COMPACT HOUSING FOR A COSMETIC CONTAINER

(71) Applicant: Toly Management Limited, Zejtun (MT)

(72) Inventors: James Attard-Kingswell, Attard (MT); Paul Adams, Traxien (MT)

(73) Assignee: Toly Management Limited (MT)

( * ) Notice: Subject to any disclaimer, the term of this patent is extended or adjusted under 35 U.S.C. 154(b) by 0 days.

(21) Appl. No.: 14/231,900

(22) Filed: Apr. 1, 2014

(65) Prior Publication Data

US 2014/0299150 A1 Oct. 9, 2014

(30) Foreign Application Priority Data

Apr. 4, 2013 (GB) ..... 1306088.4

(51) Int. Cl.
*A45D 33/28* (2006.01)
*A45D 33/00* (2006.01)
(Continued)

(52) U.S. Cl.
CPC ..... *A45D 33/006* (2013.01); *A45D 33/003* (2013.01); *A45D 33/025* (2013.01);
(Continued)

(58) Field of Classification Search
CPC .... A45D 33/00; A45D 33/003; A45D 33/006; A45D 33/025; A45D 33/20; A45D 33/22; A45D 33/24; A45D 34/00; A45D 40/00; A45D 40/0068; A45D 40/18; A45D 40/22; A45D 40/24; B65D 21/0228; B65D 21/0223; B65D 21/022; B65D 21/0217; B65D 21/0204
(Continued)

(56) References Cited

U.S. PATENT DOCUMENTS 1,479,009 A * 1/1924 Reutter ..... A45D 33/006 132/294
1,626,613 A * 5/1927 Kendall ..... A45D 40/22 132/303
(Continued)

FOREIGN PATENT DOCUMENTS

CN WO 2012019316 A1 * 2/2012 ..... A45D 33/20
FR 2963216 A1 * 2/2012 ..... A45D 33/00
(Continued)

*Primary Examiner* — Robyn Doan
(74) *Attorney, Agent, or Firm* — Barnes & Thornburg LLP

(57) ABSTRACT

There is presented a compact housing for a compact cosmetic container. The housing comprises a godet receptacle adapted to receive a godet containing a cosmetic product. The housing is movable between a closed configuration, in which the cosmetic product of the received godet is covered, and an open configuration, in which the cosmetic product of the received godet is uncovered to allow a user to access the cosmetic product. When the housing is in the open configuration, the godet receptacle is movable between a locked configuration, in which removal of the godet from the godet receptacle is prevented, and a release configuration, in which removal of the godet from the godet receptacle is permitted. When the housing is in the closed configuration, the godet receptacle is in the locked configuration.

2 Claims, 8 Drawing Sheets

(51) Int. Cl.

| | |
|---|---|
| ***A45D 33/02*** | (2006.01) |
| *B65D 21/02* | (2006.01) |
| *A45D 33/22* | (2006.01) |
| *A45D 33/24* | (2006.01) |

(52) U.S. Cl.
CPC ..... *A45D 33/22* (2013.01); *A45D 33/24* (2013.01); *B65D 21/0228* (2013.01)

(58) Field of Classification Search
USPC ..... 220/23.87, 23.86; 206/581
See application file for complete search history.

(56) References Cited

U.S. PATENT DOCUMENTS

| | | | | | |
|---|---|---|---|---|---|
| 1,635,891 | A * | 7/1927 | Kendall | A45D 33/006 | 132/293 |
| 1,704,616 | A * | 3/1929 | Kendall | A45D 33/006 | 132/293 |
| 1,874,433 | A * | 8/1932 | Briggs | A45D 33/006 | 126/41 C |
| 4,972,860 | A * | 11/1990 | Yuhara | A45D 40/22 | 132/293 |
| 2008/0265731 | A1* | 10/2008 | Moon | A45D 33/20 | 312/333 |

FOREIGN PATENT DOCUMENTS

| | | | | |
|---|---|---|---|---|
| KR | EP 1468624 A1 * | 10/2004 | ..... | A45D 33/20 |
| WO | WO 9620622 A1 * | 7/1996 | ..... | A45D 40/22 |

* cited by examiner

COMPACT HOUSING FOR A COSMETIC CONTAINER

FIELD OF INVENTION

The present invention relates to the field of cosmetic containers, and more particularly to a compact housing for a cosmetic container.

BACKGROUND TO THE INVENTION

Conventional compact cosmetic containers typically comprise one or more cosmetic products (such as lipstick, lip-gloss, foundation, eye shadow, mascara concealer or blusher for example) and a housing which encloses and protects the cosmetic product(s) when the user does not wish to use it.

Various structures have been proposed for compact cosmetic containers of the above kind, some of which employ slide-type mechanisms for opening and closing the housing. Other cosmetic containers employ rotatable clam-type mechanisms for opening and closing the housing.

Such mechanisms can be simple and quick to operate, thereby providing easy access to the cosmetic product(s) housed in the container.

The aforementioned conventional cosmetic containers are widely used and have resulted in features which may be viewed as commonplace and standard.

SUMMARY OF THE INVENTION

According to a first aspect of the invention, there is provided a compact housing for a compact cosmetic container according to claim 1.

Embodiments thus provide a simple and reliable compact housing for supporting a solid, liquid, paste or powder cosmetic product provided on a godet.

In the field of cosmetic packaging, a godet is typically otherwise referred to as a godet platform, a godet tray, tray or platform that is adapted to support and/or hold a cosmetic product such as a pressed powder. Typically, a godet holding a cosmetic product is combined with a housing so as to create a compact cosmetic container that contains the cosmetic product. The godet may be provided by a first supplier, and the housing may be provided a second, different supplier.

Embodiments may therefore provide a re-fillable cosmetic container and a re-fill (i.e. a godet containing a cosmetic product).

Embodiments may reduce the risk of unintentional removal of a godet, provide original and refined aesthetics, and do not result in an unacceptable overall size. Also, embodiments provide a compact cosmetic container which may offer greater satisfaction and pleasure to a consumer, thereby enhancing the appeal and marketability of the cosmetic product is contains.

A compact cosmetic container according to an embodiment of the invention may be assembled by combining a conventional godet with a compact housing according to the invention. Such an embodiment may be beneficial for a situation where the technical, manufacturing or cost constraints of the godet manufacturer/supplier are such that it is preferable for the housing manufacturer/supplier to provide a pre-assembly housing component which includes additional features and/or components.

With a godet being removable, embodiments may cater for replacement of the cosmetic product, thus enabling a user a lower cost option than replacing the entire container for example. Such embodiments may therefore make it economically viable for a manufacturer to create a more prestigious, substantial and/or and elegant compact housing which can be re-used with different cosmetic products.

It will be understood that embodiments provide a compact cosmetic container with a re-fillable feature provided by (or as part of) a pre-assembly component. The container may comprise a pre-assembly housing component according to an embodiment of the invention.

Embodiments may provide a compact housing for cosmetics which includes a move-to-release, move-to-lock mechanism for enabling the housing to be re-filled with a replacement godet.

The cosmetic product may be any facial or bodily cosmetic or beauty treatment product including lipstick, lip-gloss, eye-brow, eye-shadow, concealer, blusher, foundation, skin-treatment, compressed powder and the like.

According to another aspect of the invention, there is provided a godet supporting a cosmetic product.

Further developments of the invention are the subject-matter of the dependent claims.

BRIEF DESCRIPTION OF THE DRAWINGS

An example of the invention will now be described with reference to the accompanying diagrams, in which.

DETAILED DESCRIPTION

Figure 1:
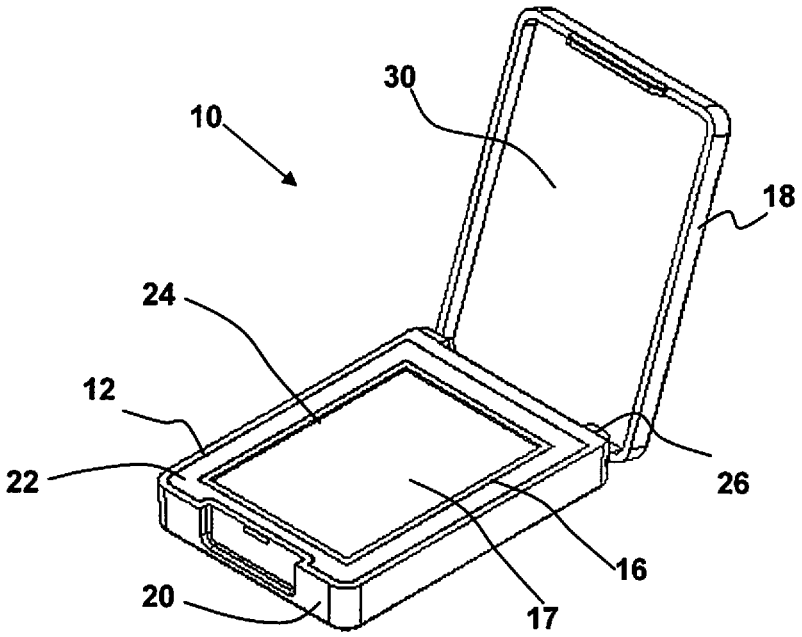
FIG. 1 shows a compact cosmetic container according to an embodiment of the invention in an open configuration.
Figure 2:
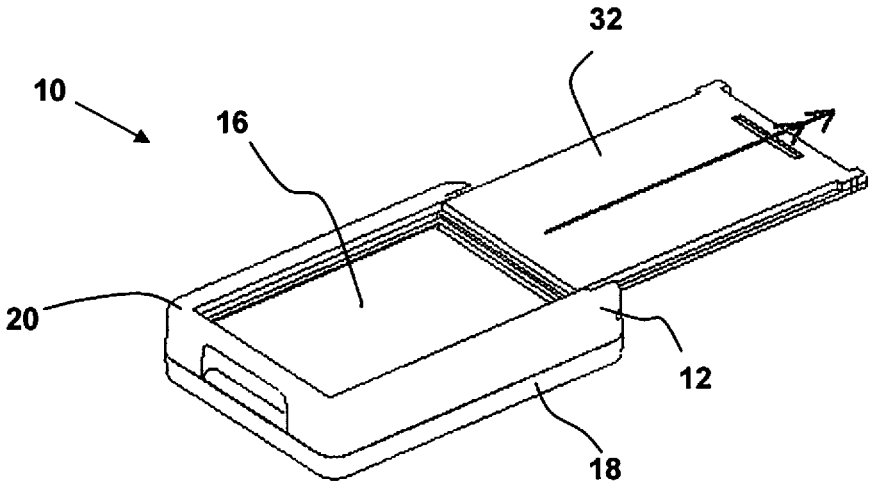
FIG. 2 shows the container of FIG. 1 in a closed configuration and in an upside-down orientation, wherein the godet cover is slid outwardly from the base portion so as to expose the aperture.
Figure 3:
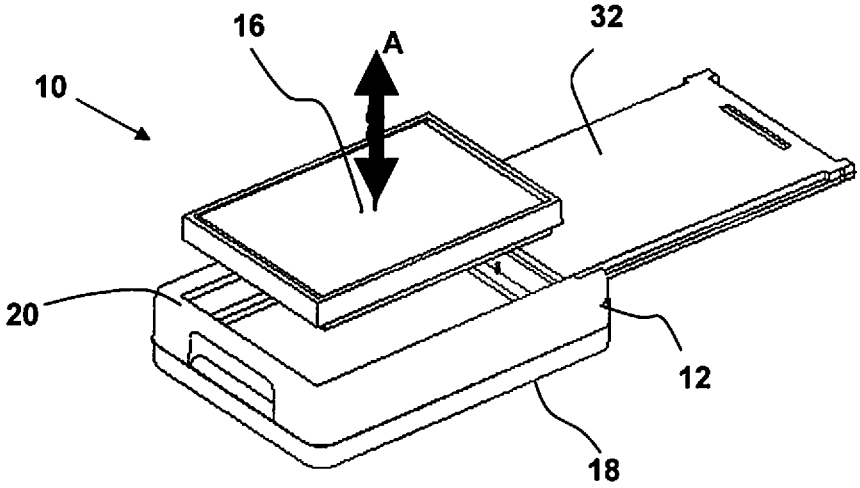
FIG. 3 shows the container of FIG. 2, wherein removal or insertion of a godet from the container is depicted.

Referring to FIGS. 1-3, there is shown a compact cosmetic container 10 according to an embodiment of the invention. FIG. 1 shows the container 10 in an open configuration, and FIGS. 2 and 3 show the container in a closed configuration and in an upside-down orientation. The container 10 comprises a housing 12 formed with an aperture 14 for receiving a godet 16 supporting a cosmetic product 17. A godet is typically otherwise referred to in the field of cosmetic packaging as a godet tray, a tray or a platform that is adapted to support or hold a cosmetic product such as a pressed powder.

The housing 12 is formed from a lid portion 18 and a base portion 20, and the aperture 14 is formed in the center of the base portion 20.

Here, the godet 16 is inserted or removed into the aperture 14 from below (as indicated by the arrow labeled "A" in FIG. 3). When inserted, the top surface of the cosmetic product 17 is slightly recessed from the upper surface 22 of the base portion 20. In other words, the assembled container 10 has a housing 12 with a recess 24 in which the cosmetic product 17 is supported.

The lid 18 and base 20 portions are rotatably connected to each other by a hinge 26. Rotation of the lid portion 18 relative to the base portion 20 moves the compact case between an open and closed configuration. In the closed configuration, the lid 18 covers the cosmetic product 17 and the upper surface 22 of the base portion 20. In the open configuration (shown in FIG. 1), the lid portion 18 is spaced apart from the cosmetic product 17 and the upper surface 22 of the base portion 20 so as to enable a user to access the cosmetic product 17.

In the embodiment shown in FIGS. 1-3, the lid portion 18 is provided with a mirror 30 on its surface that faces the cosmetic product 17 and the upper surface 22 when in the closed configuration. Thus, when in the open configuration, the mirror 30 is exposed to the user.

Further, in the embodiment shown in FIGS. 1-3, the base portion 20 is provided with a godet cover 32 that is slidable relative to the base portion 20 so as to permit or prevent insertion or removal of the godet into/from the housing 12. As shown in FIG. 2, the godet cover 32 may be slid outwardly from the base portion 20 so as to expose the aperture 14 (as indicated by the arrow labeled "B" in FIG. 2). With the godet cover 32 slid outwardly from the base portion 20, a godet 16 can be inserted into or removed from the housing 12 (as indicated by the arrow labeled "A" in FIG. 3).

The embodiment described above therefore comprises what may be referred to as a godet compartment having a slidable cover which must be slid open to enable a godet to be removed or inserted from/into the godet compartment.

Figure 4:
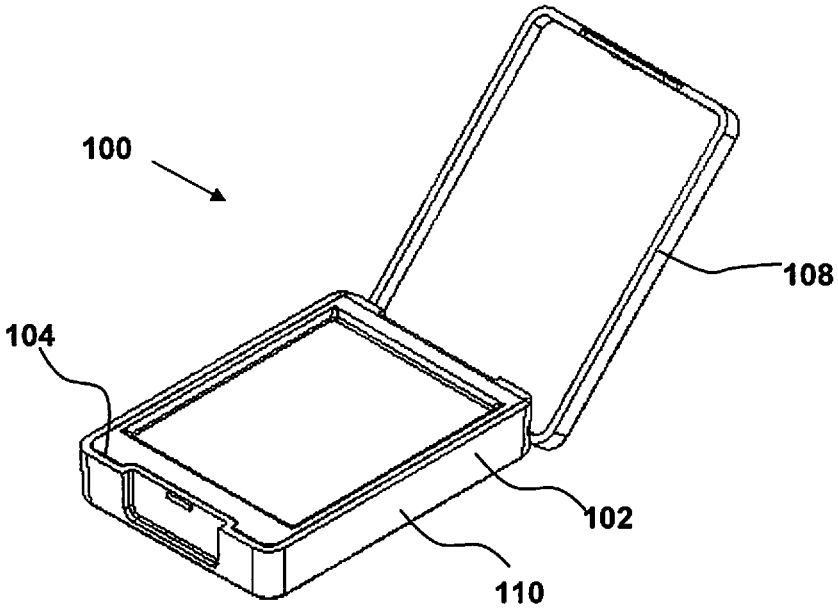
FIG. 4 shows a compact housing according to an embodiment, wherein the housing is in an open configuration.
Figure 5:
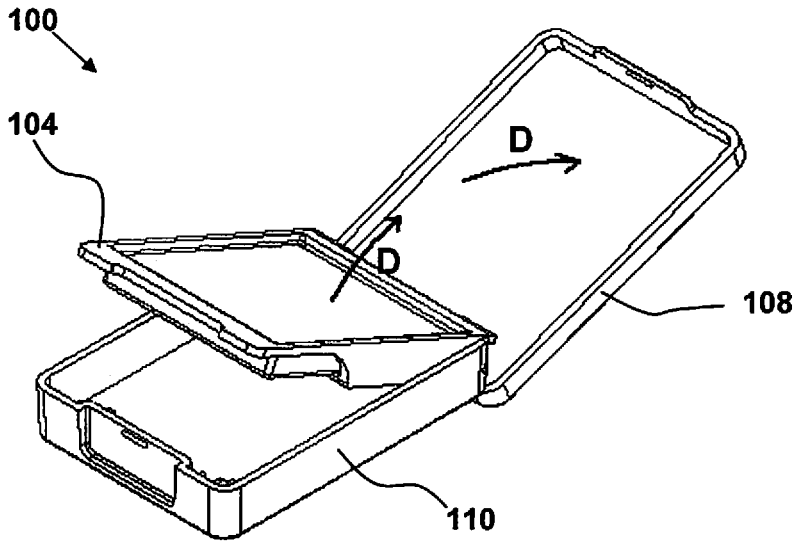
FIG. 5 shows the compact housing of FIG. 4, wherein the lid portion of the housing has been moved relative to the base portion so as to move the pocket to a release configuration.

Referring now to FIGS. 4-6, there is shown a compact cosmetic container 100 according to another embodiment of the invention. The container 100 comprises a housing 102 including a receptacle 104 for receiving a godet 16 supporting a cosmetic product 17.

The housing 102 is formed from a lid portion 108 and a base portion 110, and the receptacle 104 is provided between the lid 108 and base 110 portions.

Here, the godet 16 can be inserted into or removed from the receptacle 104 as indicated by the arrow labeled "C" in FIG. 6).

The lid 108 and base 110 portions are rotatably connected to each other by a hinge 112. Rotation of the lid portion 108 relative to the base portion 110 moves the compact case between an open and closed configuration. In the closed configuration, the lid portion 108 covers the receptacle 104 so as to prevent a user accessing the cosmetic product 17. In the open configuration (shown in FIGS. 4-6), the lid portion 108 is spaced apart from the cosmetic product 17 and the base portion 110 so as to enable a user to access the cosmetic product 17.

In the embodiment of FIGS. 4-6, the receptacle 104 is formed as a pocket 104 which is adapted to receive a godet 16 holding a cosmetic product 17. The pocket is rotatable relative to the lid 108 and base 110 portions so as to move between a locked configuration and a release configuration.

As illustrated in FIG. 4, when the pocket 104 is in a locked configuration, the mouth 114 of the pocket is covered by the base portion 110 of the housing 112.

As illustrated in FIG. 5, when the pocket 104 is in a release configuration, the mouth 114 of the pocket 104 is uncovered so as to permit insertion/removal of a godet 16 to/from the pocket (via the mouth 114 of the pocket 104).

Figure 6A:
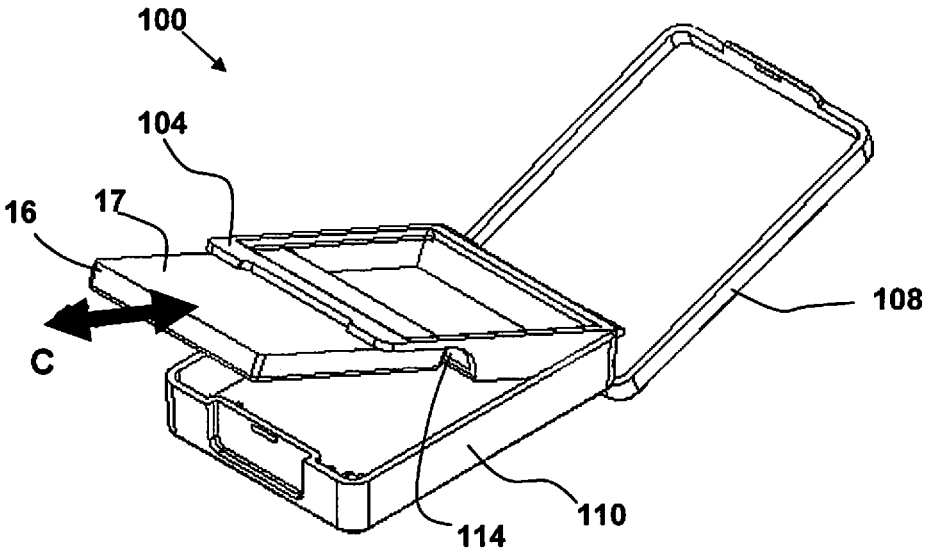
FIG. 6A shows the compact housing of FIG. 5, wherein removal or insertion of a godet is depicted.
Figure 6B:
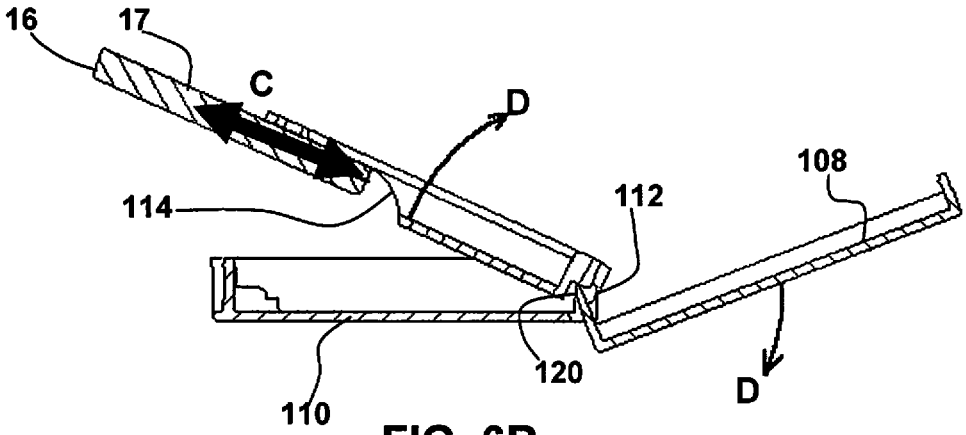
FIG. 6B is a cross-sectional view of the compact housing and godet shown in FIG. 6A.

As depicted by the arrows labeled D in FIGS. 5 and 6B, movement of the lid portion 108 relative to the base portion from a first open configuration (shown in FIG. 4) to a second open configuration (shown in FIGS. 5-6) moves the pocket 104 from the locked configuration to the release configuration. Referring to FIGS. 6A and 6B, it can be seen that when the pocket 104 is in the open configuration, a godet 16 can be slidably inserted/removed to/from the pocket 104 (as indicated by the arrow labeled "C").

The embodiment described above therefore comprises what may be referred to as a godet pocket which can be raised to an expose the mouth of the pocket and enable a godet to be removed or inserted from/into the godet pocket. The godet pocket is raised by rotating the lid portion 108 beyond a first open configuration, whereby a lever part 120 at the hinged end of the lid portion 108 cooperates with the pocket 104 to rotate the pocket relative to the base portion 110 (and thereby lift the pocket 104 from its locked configuration to the release configuration). Accordingly, if a user simply wishes to access a cosmetic product 17 held in the container 100 the user moves the lid portion 108 to a first open position as shown in FIG. 4, wherein the pocket 104 remains in its locked configuration. If the user wishes to replace cosmetic product 17, the user moves the lid portion 108 from the first open position (shown in FIG. 4) to a second open position as shown in FIG. 5, whereby the pocket 104 is rotated relative to the base portion 110 and moved to its release configuration (with the mouth 114 of the pocket 104 lifted into a position where it is not covered by the base portion 110). In other words, to move the pocket 104 into a release position in which a godet may be inserted/removed to/from the pocket, a user simply rotates the lid portion 108 beyond its usual open position (in normal use of the container) to a supplementary position which causes the pocket 104 to be moved to the release position.

Figure 7:
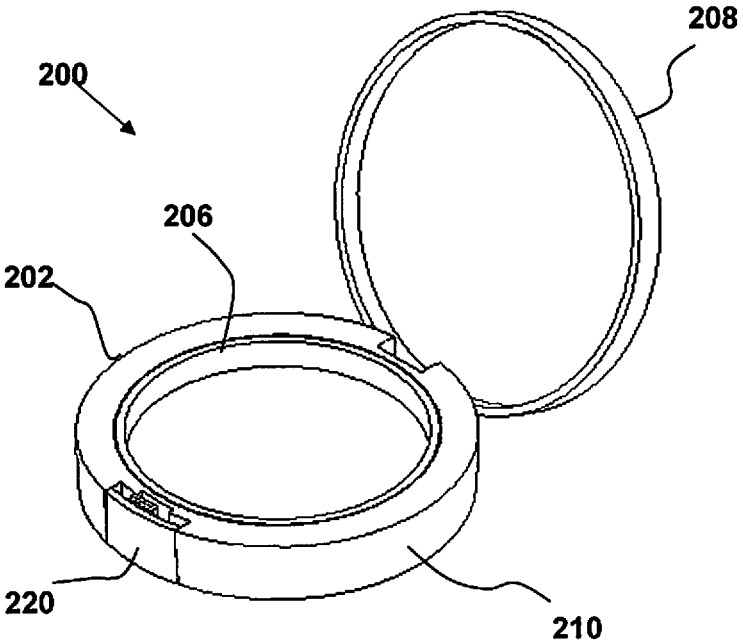
FIG. 7 shows a compact cosmetic container according to an embodiment, wherein the housing of the container is in an open configuration and the receptacle is in a locked configuration.

Turning now to FIGS. 7-9, there is shown a compact cosmetic container 200 according to another embodiment of the invention. The container 200 comprises a housing 202 including a receptacle 204 for receiving a godet tray 206.

The housing 202 is formed from a lid portion 208 and a base portion 210, and the receptacle 204 is provided in the base portion 210.

Figure 9A:
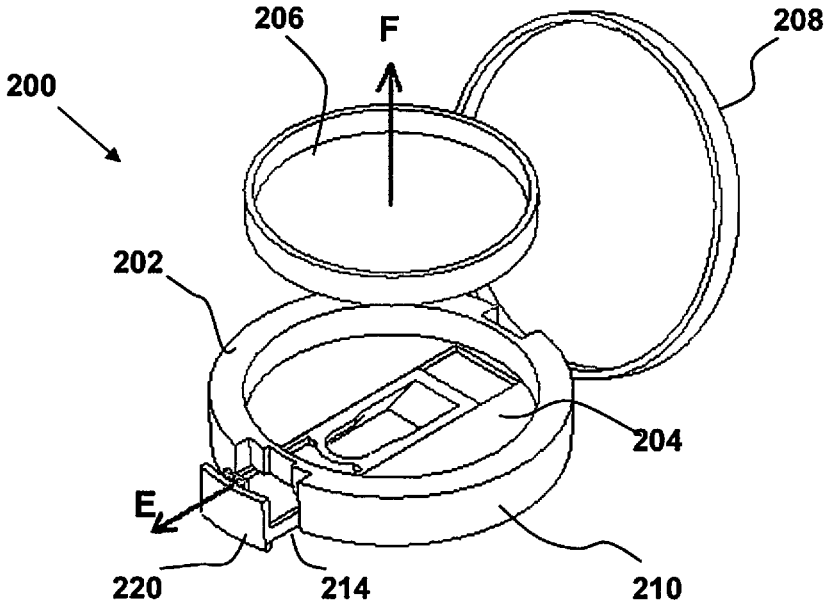
FIG. 9A shows the compact cosmetic container of FIG. 8A, wherein removal of a godet is depicted.
Figure 9B:
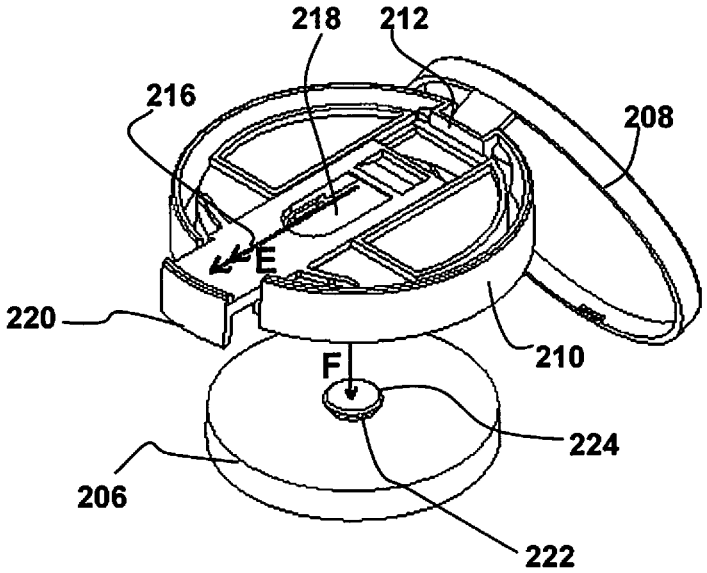
FIG. 9B shows the compact cosmetic container of FIG. 9A in an upside-down orientation.

The godet tray 206 can be inserted into or removed from the receptacle 204 as indicated by the arrow labeled "F" in FIGS. 9A and 9B).

The lid 208 and base 210 portions are rotatably connected to each other by a hinge 212. Rotation of the lid portion 208 relative to the base portion 210 moves the compact housing 202 between an open and closed configuration. In the closed configuration, the lid portion 208 covers the receptacle 204 (and a godet tray 206 received therein). In the open configuration (shown in FIGS. 7-9), the lid portion 208 is spaced apart from the receptacle 204 (and a godet tray 206 received therein) so as to enable a user to access a godet tray 206 held in the housing 202.

In the embodiment of FIGS. 7-9, the receptacle 204 is formed as a recess 204 in the base portion 210 which is adapted to receive a godet tray 206. The recess is provided with an interlock arrangement 214 adapted to releasably engage a received godet tray 206. Here, the interlock arrangement 214 comprises an elongate member 216 having an aperture 218 formed therein. The elongate member 216 has an upstanding flange 220 at one end which forms an outer surface (i.e. the part of the circumferential edge) of the housing 202.

A godet tray 206 adapted to be received by the housing 202 comprises a projection 222 extending perpendicularly from the base of the godet tray 206. The distal end of the projection 222 is provided with a circumferential flange 224, thus resulting in the distal end of the projection being wider than the middle portion of the projection 222.

The elongate member 216 is slidable relative to the base portion 210 in an outwardly radial direction so as to move the aperture 218 between a locked configuration and a release configuration.

When the aperture 218 is in the release configuration, the aperture 218 permits insertion/removal of the godet tray 206 to/from the recess 204 by allowing the projection 222 to pass through the aperture 218.

When the aperture 218 is in the locked configuration, the interlock aperture cooperates with the projection 222 to prevent insertion/removal of the godet tray 206 to/from the recess 204.

As illustrated in FIG. 7, when the interlock arrangement is in a locked configuration, a godet tray 206 is held in the recess 204 by cooperation of the circumferential flange 224 of the projection 222 with the aperture 218.

As illustrated in FIG. 9, when the interlock arrangement is in a release configuration, the aperture 218 is in a position which permits insertion/removal of a godet tray 206 to/from the recess 204.

Figure 8A:
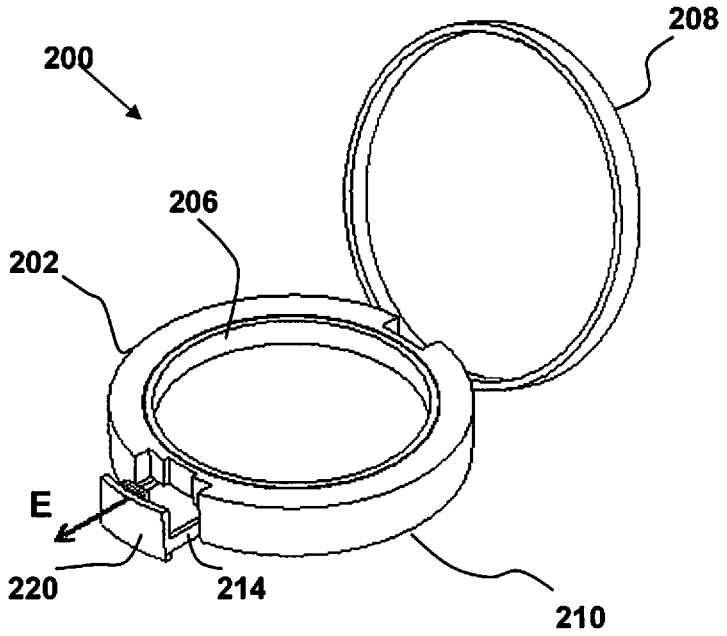
FIG. 8A shows the compact cosmetic container of FIG. 7, wherein the receptacle is moved to a release configuration.
Figure 8B:
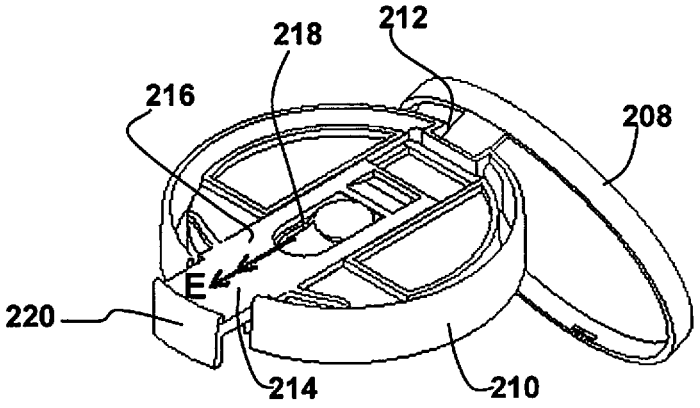
FIG. 8B shows the compact cosmetic container of FIG. 8A in an upside-down orientation.

As depicted by the arrows labeled "E" in FIGS. 8A and 8B, movement of the interlock arrangement 214 to the base portion 210 from the locked configuration to the release configuration causes movement of the aperture 218 relative to the projection 222 of the godet tray. Referring to FIGS. 9A and 9B, it can be seen that when the interlock arrangement 24 is in the release configuration, the aperture 218 permits passage of the projection 222 through the aperture 218 so that the godet tray 206 can be inserted/removed to/from the recess 204 (as indicated by the arrows labeled "F").

It is also noted that the elongate member 216 is provided with a sloped surface 230 (i.e. a surface that is angled from the longitudinal axis of the elongate member 216) adjacent the aperture 218. The sloped surface 230 is adapted to contact the projection 222 of a godet tray 206 and cause vertical movement (i.e. movement perpendicular to the horizontal upper surface of the elongate member 216) of the godet tray 206 when the elongate member 216 is moved in a horizontal direction relative to the godet tray 206. It will be understood that the sloped surface is therefore adapted to lift a godet tray 206 in an upward direction so that is projects as least partially from the mouth of the recess 204 when the interlock arrangement 214 is moved from the locked configuration to the release configuration. This may facilitate the removal of a godet tray 206 from the recess by exposing a portion of the godet tray 206 that can be gripped by a user.

The embodiment described above therefore comprises what may be referred to as a godet locking arrangement which can be unlocked and enable a godet to be removed or inserted from/into the compact housing. The godet locking arrangement is moved between and locked and unlocked configuration by sliding a member connected to the base of the housing. Accordingly, if a user simply wishes to access a cosmetic product supported by a godet tray 206 within the housing 202, the user moves the lid portion 208 to an open position as shown in FIG. 7, wherein the interlock arrangement 214 remains in its locked configuration. If the user wishes to replace the godet tray 206, the user then moves the interlock arrangement 214 from its locked configuration (shown in FIG. 7) to its unlocked configuration as shown in FIGS. 8A and 8B.

When the housing 202 is in the closed configuration, the lid portion 208 cooperates with the upstanding flange 220 of the interlock arrangement 214 to prevent the interlock arrangement from being moved from the locked configuration. Thus, a user must first open the housing 202 before the interlock arrangement 214 can be moved to its unlocked configuration.

Figure 10:
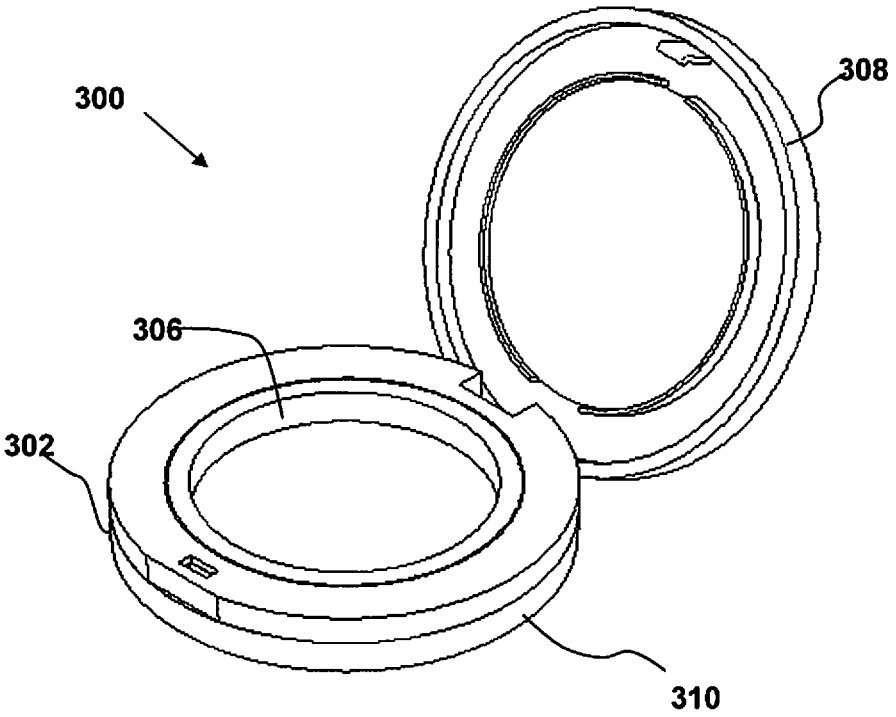
FIG. 10 shows a compact cosmetic container according to another embodiment of the invention, wherein the housing of the container is in an open configuration and the interlock arrangement is in a locked configuration.
Figure 11:
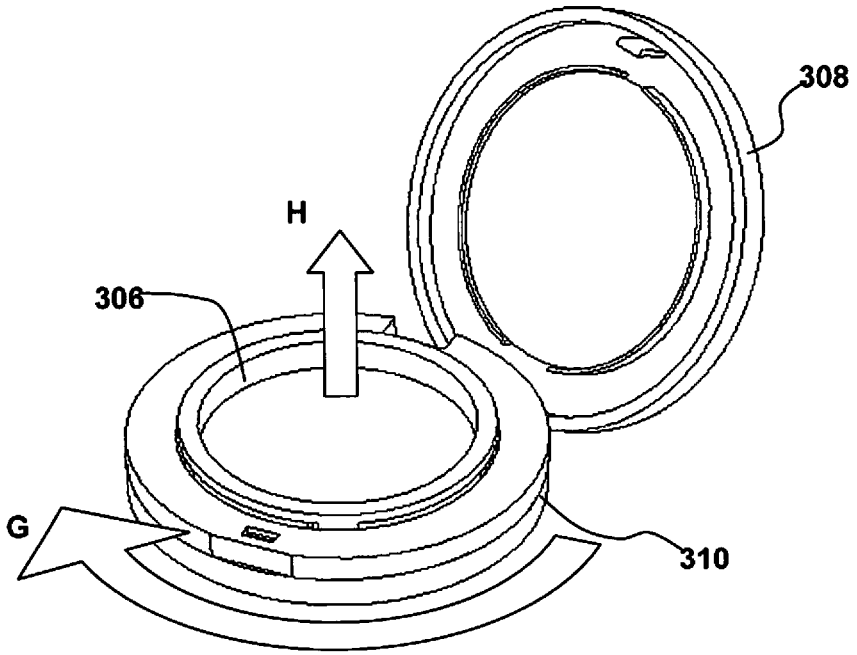
FIG. 11 shows the compact cosmetic container of FIG. 10 being moved from the locked configuration to the release configuration.
Figure 12:
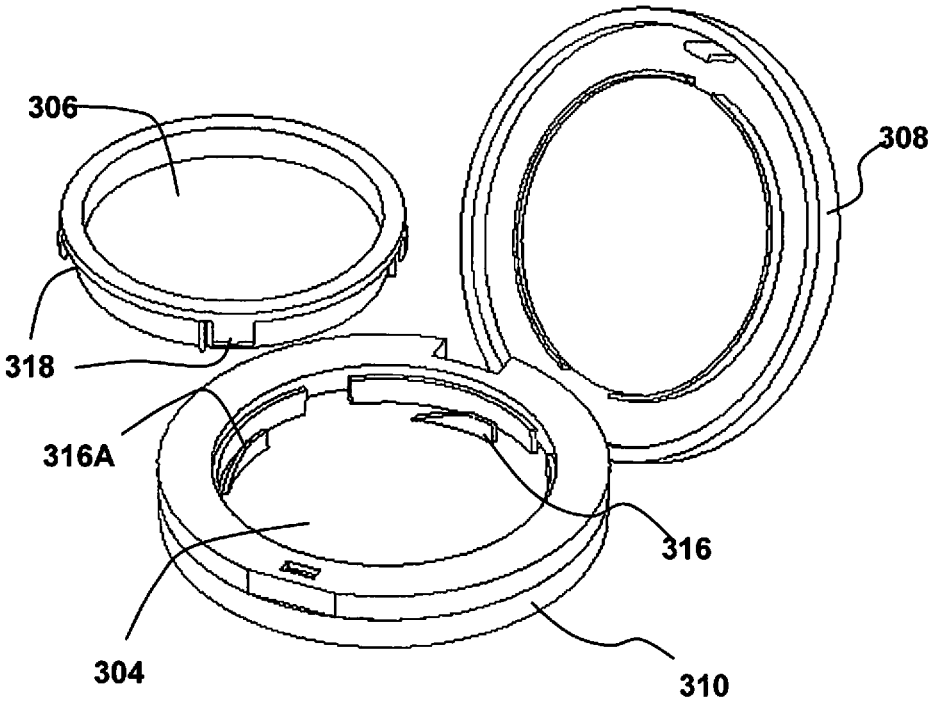
FIG. 12 shows the compact cosmetic container of FIG. 10 wherein separation or removal of a godet from the housing is depicted.

Turning now to FIGS. 10-12, there is shown a compact cosmetic container 300 according to another embodiment of the invention. The container 300 comprises a housing 302 including a receptacle 304 for receiving a godet tray 306.

The housing 302 is formed from a lid portion 308 and a base portion 310, and the receptacle 304 is provided in the base portion 310. The base portion 310 is rotatable relative to the receptacle 304 (as indicated by the arrow labeled "G" in FIG. 11, for example).

The godet tray 306 can be inserted into or removed from the receptacle 204 (as indicated by the arrow labeled "H" in FIG. 11, for example).

The lid 308 and base 310 portions are rotatably connected to each other by a hinge. Rotation of the lid portion 308 relative to the base portion 310 moves the compact housing 302 between an open and closed configuration. In the closed configuration, the lid portion 308 covers the receptacle 304 (and a godet tray 306 received therein). In the open configuration (shown in FIGS. 10-12), the lid portion 308 is spaced apart from the receptacle 304 (and a godet tray 306 received therein) so as to enable a user to access a godet tray 306 held in the housing 302.

In the embodiment of FIGS. 10-12, the receptacle 304 is formed as a generally circular recess 304 in the base portion 310 which is adapted to receive a generally circular godet tray 306.

The recess 304 is provided with an interlock arrangement adapted to releasably engage a received godet tray 306. Here, the interlock arrangement comprises a plurality of inwardly projecting flanges (not visible) that are spaced apart around the inside surface of the base portion 310. A godet tray 306 adapted to be received by the housing 302 comprises a respective plurality of recesses 318 spaced apart around the peripheral edges of the godet tray 306 so that they receive and cooperate with the inwardly projecting flanges of the base portion (when the godet tray 306 is inserted into the recess 304).

The base portion 310 is movable (e.g. rotatable) relative to the recess 304 in a circular direction so as to move the interlock arrangement between a locked configuration and a release configuration.

The recess 304 is provided with a plurality of upstanding sloped projections 316 which are spaced apart and arranged in circular arrangement near the periphery of the recess 304. Each upstanding sloped projection 316 provides a sloped surface 316A (i.e. a surface that is angled from the horizontal (base) plane of the recess floor).

When the interlock arrangement is in the release configuration, the inwardly projecting flanges of the base portion 310 permit insertion/removal of the godet tray 306 to/from the recess 304 by allowing the inwardly projecting flanges to enter or leave the respective plurality of recesses 318 spaced apart around the peripheral edges of the godet tray 306.

When the interlock arrangement is in the locked configuration, the inwardly projecting flanges cooperate with the respective plurality of recesses 316 spaced apart around the peripheral edges of the godet tray 306 to prevent insertion/removal of the godet tray 306 to/from the recess 206.

As illustrated in FIG. 10, when the interlock arrangement is in a locked configuration, a godet tray 306 is held in the recess 304 by cooperation of the inwardly projecting flanges of the base portion 310 with the respective plurality of recesses 318 spaced apart around the peripheral edges of the godet tray 306.

As illustrated in FIG. 11, the interlock arrangement is moved from the locked configuration tot the unlocked configuration by rotation of the base portion (as indicated by the arrow labeled "G" in FIG. 11).

As illustrated in FIG. 12, when the interlock arrangement is in a release configuration, the base portion 310 is in a position which permits insertion/removal of a godet tray 306 to/from the recess 304.

As depicted by the arrow labeled "H" in FIG. 11, movement of the interlock arrangement (i.e. rotation of the base portion 310) from the locked configuration to the release configuration causes (rotational) movement of the godet tray 306 relative to the upstanding sloped projections 316 of the recess 304.

The sloped surfaces 316A are adapted to contact the bottom (i.e. underside) of a godet tray 306 and cause vertical movement (i.e. movement perpendicular to the horizontal (base) plane of the recess floor) of the godet tray 306 when the base portion 310 (and coupled godet tray 306) is rotated in a circular fashion relative to the recess 304. It will be understood that the sloped surfaces 316A are therefore adapted to lift a godet tray 306 in an upward direction so that is projects as least partially from the mouth of the recess 304 when the interlock arrangement is moved from the locked configuration to the release configuration. This may facilitate the removal of a godet tray 306 from the recess by exposing a portion of the godet tray 306 that can be gripped by a user.

The embodiment described above therefore comprises what may be referred to as a godet locking arrangement which can be unlocked and enable a godet to be removed or inserted from/into the compact housing. The godet locking arrangement is moved between and locked and unlocked configuration by rotating a (base) portion of the housing relative to another portion of the housing (e.g. a floor of the recess). Accordingly, if a user simply wishes to access a cosmetic product supported by a godet tray 306 within the housing 302, the user moves the lid portion 308 to an open position as shown in FIG. 10, wherein the interlock arrangement remains in its locked configuration. If the user wishes to replace the godet tray 306, the user then moves (as depicted in FIG. 11) the interlock arrangement from its locked configuration to its unlocked configuration (depicted in FIG. 12).

When the housing 302 is in the closed configuration, the lid portion 308 cooperates with the base portion 310 to prevent the interlock arrangement from being moved from the locked configuration. Thus, a user must first open the housing 302 before the interlock arrangement can be moved to its unlocked configuration.

Embodiments described above may be summarized as having an interlock arrangement comprising a first portion of the housing which is movable relative to a second portion of the housing as to move a godet receptacle between a release configuration and a locked configuration. The first portion of the housing may comprise an elongate member with an aperture formed therein, the elongate member being slidable relative to the second portion of the housing along a sliding axis so as to move the godet receptacle between the release and locked configuration. Further, the elongate member may comprise a surface that is sloped at an angle relative to the sliding axis, the surface being adapted to cause movement of the godet in a direction perpendicular to the sliding axis when the elongate member is moved along the sliding axis.

Alternatively, the first portion of the housing may be rotatable relative to the second portion of the housing about an axis of rotation so as to move the godet receptacle between the release and locked configuration. Further, the second portion of the housing may comprise at least one surface that is sloped at an angle relative to the axis of rotation, the surface being adapted to cause movement of the godet in a direction parallel to the axis of rotation when the first portion of the housing is rotated about the axis of rotation.

Embodiments described above comprise a clam-type compact case. Alternative embodiments may comprise an opening and closing mechanism which can be described as slide-to-open, slide-to-close mechanism.

The various embodiments of compact housings described above include arrangements which can be described as move-to-lock, move-to-unlock mechanisms for enabling a user to secure or remove a godet tray within/from the housing.

While specific embodiments have been described herein for purposes of illustration, various modifications will be apparent to a person skilled in the art and may be made without departing from the scope of the invention.

For example, it will be appreciated that other embodiments may be used to contain a godet tray for supporting an suitable type of cosmetic products (such as lip-gloss, foundation, eye shadow, mascara or blusher for example).

Also, although the embodiments have been described as having rectangular or circular cross-sectional shape, other embodiments may comprise housing having a different cross-sectional shape (such a regular or irregular polygonal shape).

The invention claimed is:

1. A compact cosmetic container comprising:

a housing formed from a lid portion and a base portion, wherein said base portion comprises a receptacle receiving a tray portion which contains a cosmetic product, and wherein:

said lid portion and base portion are rotatably connected to each other by a hinge;

said housing is movable between a closed configuration, in which the cosmetic product of the received tray portion is covered, and an open configuration, in which the cosmetic product of the received tray portion is uncovered to allow a user to access the cosmetic product;

said receptacle comprises an interlock arrangement which releasably engages said tray portion;

said interlock arrangement includes an elongate member having one end abutting said hinge and the other end including an upstanding flange which forms an outer surface of said housing, wherein said elongate member also comprises an aperture formed between said two ends;

said tray portion comprises a projection which extends perpendicularly from a base of said tray portion;

said aperture of said elongate member permits entry of said projection, wherein said elongate member is movable along a single axis between a locked position, in which said aperture engages with said projection of said tray portion to prevent removal of said tray portion from the receptacle and a release configuration, in which said aperture and said projection disengage to thereby permit removal of said tray portion from said receptacle and said housing comprises a sloped surface angled with respect to said single axis, wherein as said elongate member is moved along said single axis from the locked configuration to the release configuration, said sloped surface pushes against said projection and moves the tray portion in a direction perpendicular to said single axis to release said tray portion from the receptacle.

2. The compact cosmetic container of claim 1, wherein the cosmetic product comprises at least one of: lipstick; lipgloss; eye-brow; eye-shadow; concealer; blusher; foundation; compressed powder and skin-treatment.

* * * * *